US007475949B2

(12) United States Patent
Helsel et al.

(10) Patent No.: US 7,475,949 B2
(45) Date of Patent: Jan. 13, 2009

(54) EDGE CUTTER ASSEMBLY FOR USE WITH A ROTATABLE DRUM

(75) Inventors: Eric P. Helsel, New Enterprise, PA (US); Stephen P. Stiffler, New Enterprise, PA (US)

(73) Assignee: Kennametal Inc., Latrobe, PA (US)

( * ) Notice: Subject to any disclaimer, the term of this patent is extended or adjusted under 35 U.S.C. 154(b) by 127 days.

(21) Appl. No.: 11/598,324

(22) Filed: Nov. 13, 2006

(65) Prior Publication Data

US 2008/0111418 A1 May 15, 2008

(51) Int. Cl.
*E21C 35/18* (2006.01)

(52) U.S. Cl. ..... 299/108; 299/39.8

(58) Field of Classification Search ..... 299/108, 299/39.8

See application file for complete search history.

(56) References Cited

U.S. PATENT DOCUMENTS 4,119,350 A * 10/1978 Sander et al. ..... 299/87.1
4,201,421 A 5/1980 Den Besten et al.
4,608,318 A 8/1986 Makrides et al.
4,723,867 A 2/1988 Wirtgen
5,505,598 A 4/1996 Murray
5,647,641 A * 7/1997 Sulosky et al. ..... 299/39.8
6,371,566 B1 4/2002 Heahn
6,457,779 B1 10/2002 Busley et al.

OTHER PUBLICATIONS

Catalog "Kennametal Construction Tooling Systems" B84-178(10) A5 (16 pages)1985.

* cited by examiner

*Primary Examiner*—John Kreck
(74) *Attorney, Agent, or Firm*—Matthew W. Smith

(57) ABSTRACT

An edge cutter bit assembly for use in conjunction with a rotatable drum having an edge. The edge cutter bit assembly includes a holder that includes a plurality of bores wherein each bores carries a chisel cutter bit so that the chisel cutter bit is non-rotatable. The holder is oriented with respect to the drum so that at least a portion of each one of the cutter bits extends past the edge of the drum.

20 Claims, 4 Drawing Sheets

EDGE CUTTER ASSEMBLY FOR USE WITH A ROTATABLE DRUM

BACKGROUND OF THE INVENTION

The invention pertains to an assembly that impinges the earth strata such as, for example, asphaltic roadway material in a road planing operation. More specifically, the invention pertains to an improved assembly that impinges the earth strata (e.g., asphaltic roadway material) in such a fashion so as to exhibit an improvement in the operational efficiency of the assembly.

Heretofore, it has been common practice to mill the surface of a roadway, and especially a roadway made of asphaltic material. Such a practice has been termed a road planing operation.

A road planing machine is used to perform the road planing operation. Exemplary patent documents that describe road planing machines include U.S. Pat. No. 6,457,779 B1 to Busley et al.; U.S. Pat. No. 6,371,566 B1 to Haehn; U.S. Pat. No. 5,505,598 to Murray; and U.S. Pat. No. 4,723,867 to Wirtgen.

A road planing machine includes a rotary road planing drum that has opposite ends and a generally cylindrical surface. The road planing drum is driven or powered by an engine whereby the drum rotates about its longitudinal axis. The surface of the road planing drum carries a plurality of blocks or holders. Each block or holder carries a road planing bit wherein the axial forward end of the bit has a hard carbide tip. Typically, the blocks or holders are arranged in a helical pattern about the surface of the road planing drum so as to, in essence, form a helical flight about the surface of the drum.

In operation, the road planing drum is rotated under the power of the engine so as to drive the hard carbide tip of the road planing bit into the asphaltic material so as break up and disintegrate the asphaltic material into smaller pieces or chunks that one can term debris. The debris is fed into a conveyor located in front of the drum and carried away from the location of the road planing activity.

The pieces or chunks (i.e., debris) located near the opposite ends of the drum may sometimes be trapped between the opposite edge of the drum and the housing of the road planing machine. In the past, in order to try to direct the debris past the opposite edges back into the helical flights of the drum, drums have exhibited edge cutter assemblies. An edge cutter assembly comprised a block with three or four bores wherein each bore contained a rotatable cutting bit. Each block has an orientation such that it extends past the opposite edge of the road planing drum so as to gather up the debris. While the use of such an edge cutter assembly has provided satisfactory results, there remains a need to provide an assembly such as, for example, a road planing assembly that exhibits improved operational efficiency. The improvement in operational efficiency can take place through an increase in the ability of the edge cutter assembly to gather and direct debris toward the helical flight.

During the road planing operation, it is not uncommon for the opposite ends of the drum, as well as the main tool holders (or blocks), to experience damage due to impingement against uncut roadway material wherein the uncut roadway material essentially defines the edge of the cutting path. Edge cutters function to cut the sides of the cutting path of the road planing drum and thereby protect the ends of the drum and the main tool holders from damage due to impingement against the uncut roadway material. Edge cutters also function to improve the quality of the cutting path by making a straighter edge in the roadway material that defines the cutting path.

Heretofore, the edge cutter assemblies have been useful to protect the opposite edges from damage. As mentioned above, the earlier edge cutter assembly comprised a block with three or four bores wherein each bore contained a rotatable cutting bit. While the use of such an edge cutter assembly has provided satisfactory results, there remains a need to provide an assembly such as, for example, a road planing assembly that exhibits improved ability to protect the opposite edges of the road planing drum. The improvement in protection can take place through an improved edge cutter assembly.

It should be appreciated that although the above discussion describes road planing machines, the present invention is also applicable to other apparatus. For example, the present invention is applicable to reclaimer (cold recycling) machines.

SUMMARY OF THE INVENTION

In one form thereof, the invention is an edge cutter bit assembly for use in conjunction with a rotatable drum that has an edge. The edge cutter bit assembly comprises a holder that contains a plurality of bores Each one of the bores carries a chisel cutter bit so that the chisel cutter bit is non-rotatable. The holder is oriented with respect to the drum so that at least a portion of each one of the cutter bits extends past the edge of the drum.

In still another form thereof, the invention is a rotatable drum assembly that comprises a drum that has at least one edge and a longitudinal surface. The assembly further includes an edge cutter bit assembly mounted to the surface of the drum. The edge cutter assembly comprises a holder that contains a plurality of bores. Each one of the bores carries a chisel cutter bit so that the chisel cutter bit is non-rotatable. The holder is oriented with respect to the drum so that at least a portion of each one of the cutter bits extends past the edge of the drum.

BRIEF DESCRIPTION OF THE DRAWINGS

The following is a brief description of the drawings that form a part of this patent application.

DETAILED DESCRIPTION OF THE INVENTION

Figure 7:
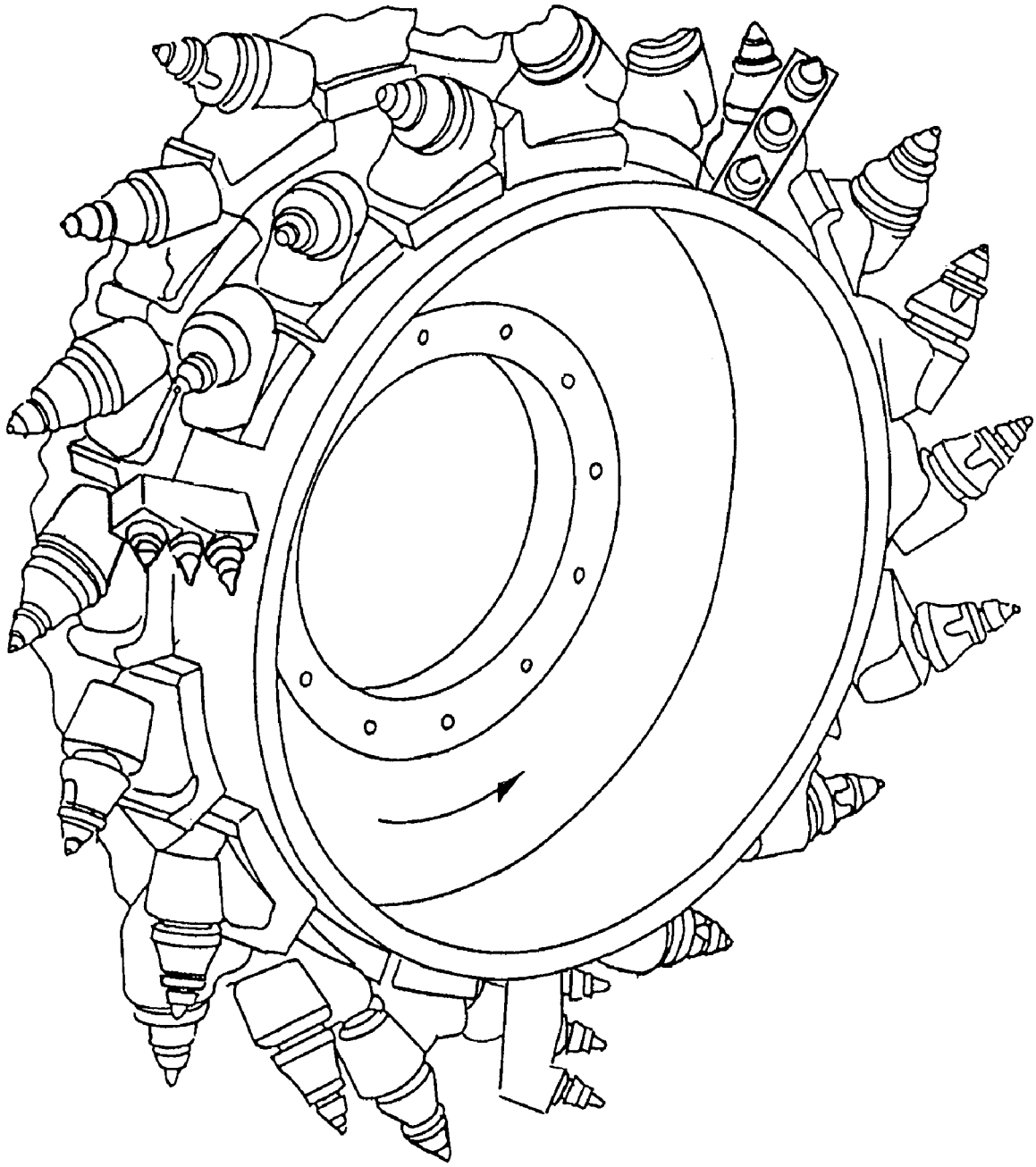
PRIOR ART FIG. 7
FIG. 7 is an isometric view of one edge of a PRIOR ART road planing drum.

FIG. 7 illustrates a PRIOR ART road planing drum assembly. More specifically, this prior art assembly includes a road planing drum that has a generally cylindrical surface and opposite edges. The drum further has a plurality of blocks mounted thereto. Each one of the blocks carries a rotatable cutting tool (or road planing bit). The road planning drum assembly further includes an edge cutter assembly. This edge cutter assembly includes a block, which is mounted to the surface of the drum, that contains a trio of bores wherein each bore carries a rotatable road planning bit. The edge cutter assembly is disposed so that at least a portion thereof extends past the edge of the road planing drum.

Figure 1:
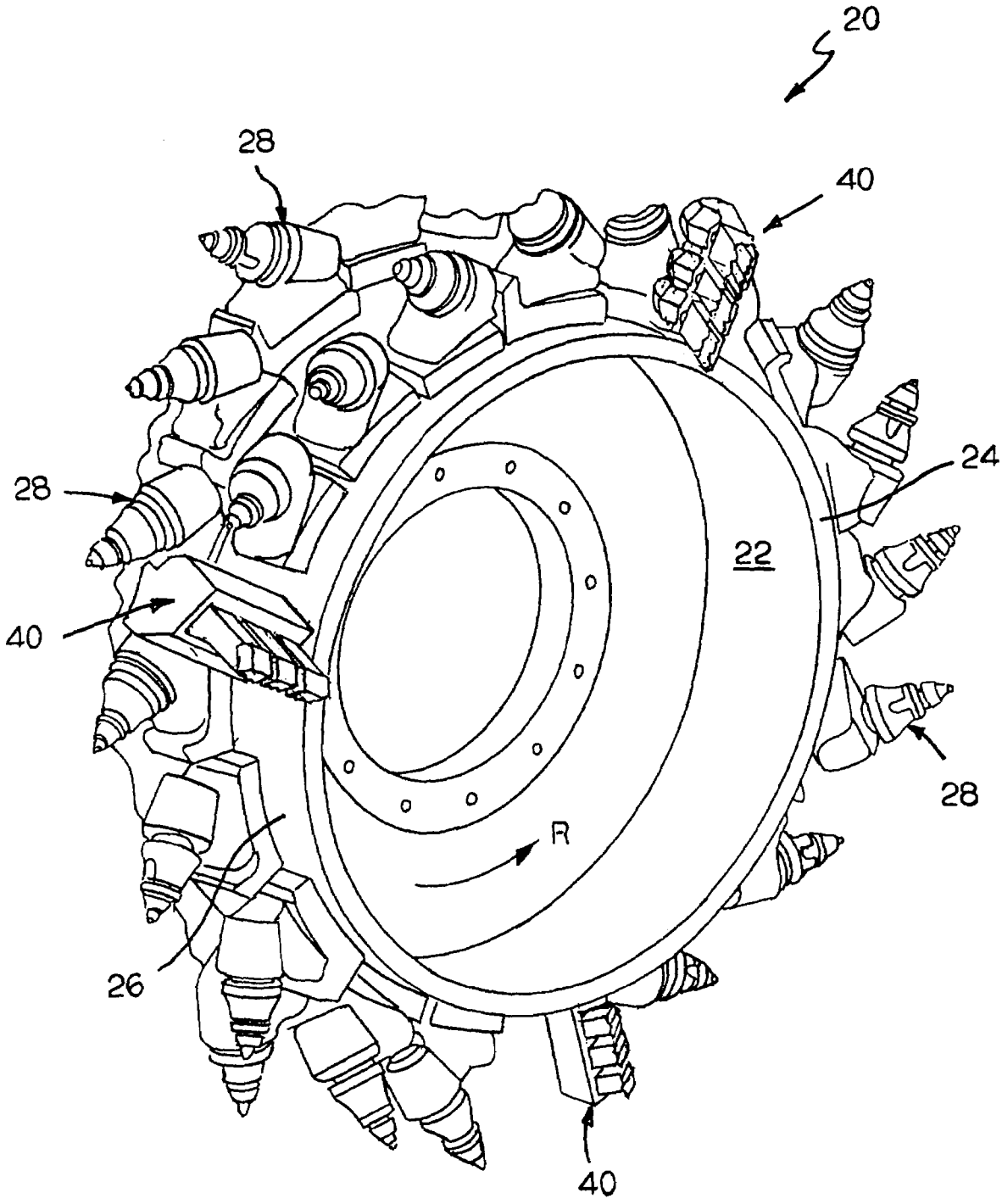
FIG. 1 is an isometric view of one edge of a road planing drum wherein the drum contains a trio of edge cutter assemblies of the present invention spaced about the surface of the edge at about 120 degrees apart.

Referring to a specific embodiment of the invention (as illustrated in FIGS. 1-6), FIG. 1 illustrates a specific embodiment of a road planing drum assembly generally designated as 20. Road planing drum assembly 20 includes a road planing drum 22 that has opposite edges wherein one edge 24 is shown in FIG. 1. The drum 22 further includes a generally cylindrical surface 26, which extends in a longitudinal direction so that one could term it as a longitudinal surface.

The road planing drum assembly 20 further contains a plurality of road planing bit-block assemblies (generally designated as 28). Each road planing bit-block assembly 28 is mounted to the surface 26 of the road planing drum 22 so as to typically form a helical pattern or flight. The helical flight of road planing bit-block assemblies 28 facilitates the transfer of debris to a central location along the axial length of the drum as will be described in more detail hereinafter.

The road planing drum assembly 20 further includes a plurality of edge cutter assemblies generally designated as 40. Although the number of these edge cutter assemblies 40 may vary depending upon the circumstances, as illustrated in FIG. 1, there is a trio of edge cutter assemblies 40. Referring to FIG. 1, each edge cutter assembly 40 is located at the one edge 24 of the road planing drum 22. Each edge cutter assembly 40 is spaced about 120 degrees apart about the circumference of the edge 24. As can be seen (and as well be described in more detail hereinafter), the orientation of each edge cutter assembly 40 is such so that it extends (in the axial direction) past the one edge 24.

Each edge cutter assembly 40 comprises a holder 42. Holder 42 has a central longitudinal axis A-A (see FIG. 2). The holder 42 comprises a trio of block segments (44, 46 and 48) that are structurally the same. One preferred block segment is a commercial embodiment sold by Kennametal Inc. of Latrobe, Pa. 15650 under the designation 87B Block (Part No. 1012275). Referring to block segment 48 as an example for all of the block segments, block segment 48 contains a central bore 50, which is defined by a bore wall 56. Bore 50 has an axial forward end 52 and an axial rearward end 54. The block segments (44, 46, 48) are joined together by connector/spacers 60 and 62. More specifically, connector/spacer 60 joins together block segments 44 and 46 and connector/spacer 62 joins together block segments 46 and 48.

Holder 42 is mounted (e.g., by welding) to the surface 26 of the drum 22. The orientation of the holder 42 is such that the central longitudinal axis A-A of the holder is disposed at an angle C with respect to a line (see line B-B in FIG. 2) perpendicular (or normal) of the longitudinal surface 26 of the drum 22. In one preferred embodiment, the holder 42 is disposed so that the central longitudinal axis A-A thereof is at an angle C with respect to a line (B-B) normal to the longitudinal surface of the drum equal to between about zero degrees and about thirty degrees. In another preferred embodiment, the holder 42 is disposed so that the central longitudinal axis A-A thereof is at an angle C with respect to a line (B-B) normal to the longitudinal surface of the drum equal to between about five degrees and about fifteen degrees.

Figure 2:
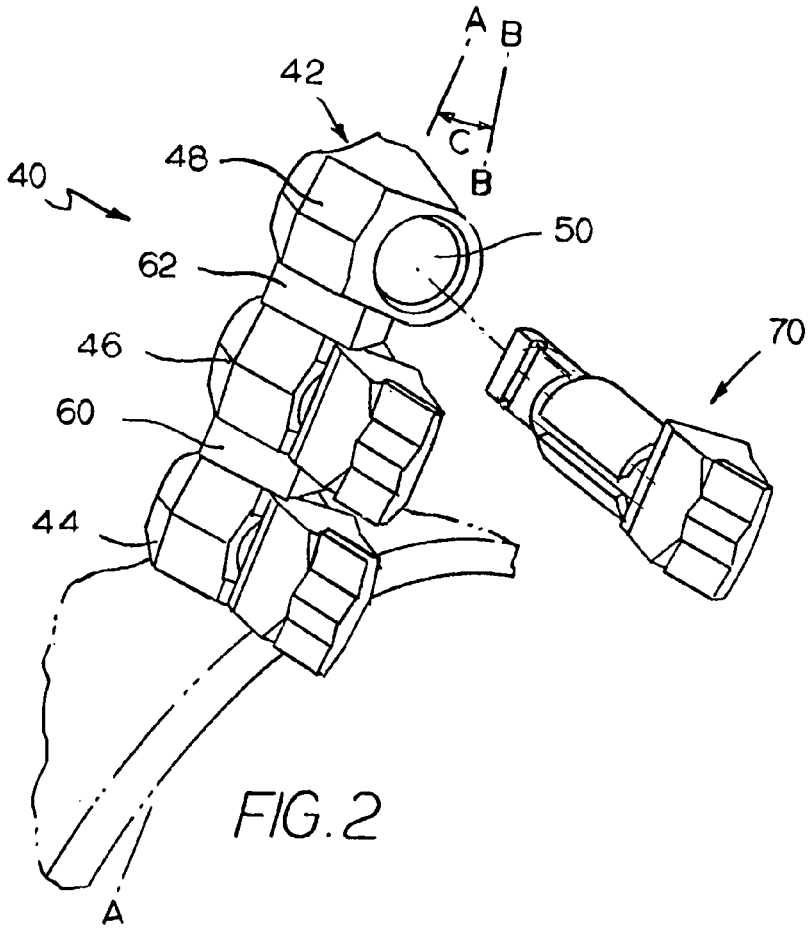
FIG. 2 is an isometric view of one edge cutter assembly from FIG. 1 wherein one of the cutter bits has been exploded away from bore of its corresponding block.
Figure 3:
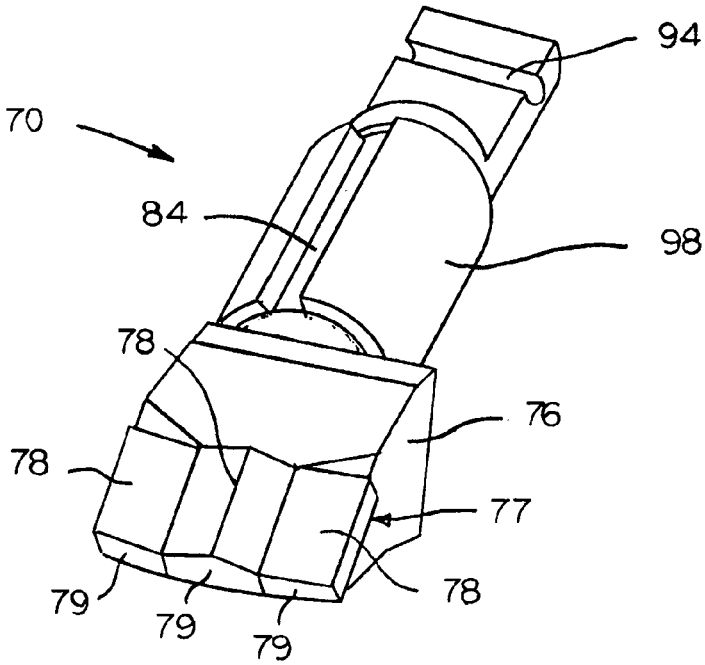
FIG. 3 is an isometric view of the cutter bit of FIG. 2.
Figure 4:
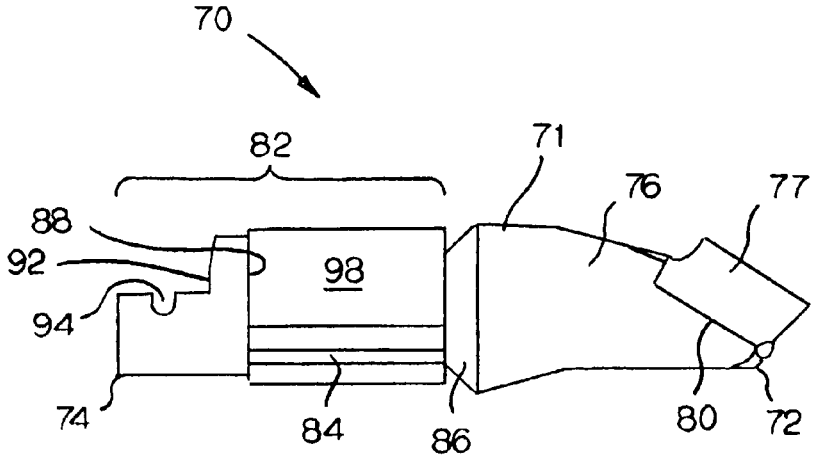
FIG. 4 is a side view of the cutter bit of FIG. 2.
Figure 5:
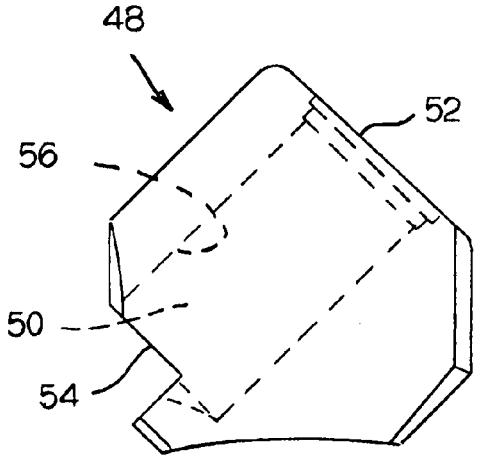
FIG. 5 is a side view of one segment of the block or holder of FIG. 2.
Figure 6:
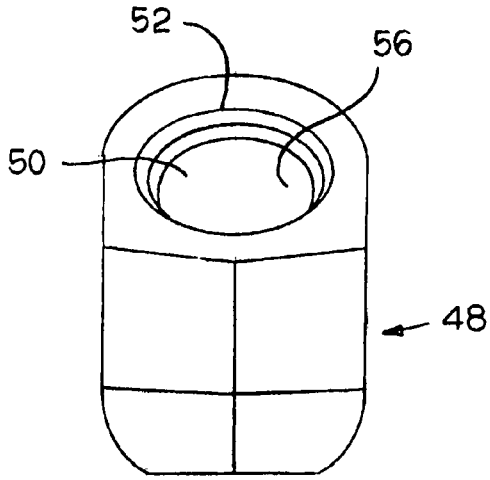
FIG. 6 is a front view of the segment of the block or holder of FIG. 6.

As can be seen in FIG. 2, at least a part of the assembly 40 extends past the edge 24 of the drum 22. As can be appreciated the magnitude of the extension of the holder past the edge can vary depending on a designed width that is more than the axial length of the drum and less than the maximum cutting width of the road planing drum.

Each edge cutter assembly 40 further includes a non-rotatable chisel cutter bit generally designated as 70. One cutter bit is a commercial embodiment sold by Kennametal Inc. of Latrobe, Pa. 15650 under the designation AR150 87 Carbide-Edged Tooth (Part No. 1012240). As is apparent from the description below taken in conjunction with the relevant drawings, a chisel cutter bit is a non-rotatable style of cutter bit that has a hard insert adjacent to the axial forward end thereof. At least a portion of the axial forward end of the hard insert presents a generally chisel-shaped cutting edge. In this context, a generally chisel-shaped cutting edge may comprise a sharp cutting edge. Applicants further contemplate that a generally chisel-shaped cutting edge may be defined by an edge that has some thickness. For example, the chisel-shaped cutting edge can comprise a generally planar or generally arcuate surface (or a combination thereof) that has a thickness.

Cutter bit 70 has an elongate body 71 that has an axial forward end 72 and an axial rearward end 74. There is a head portion 76 adjacent to the axial forward end 72. The head portion 76 contains a notch 80 that receives therein a hard insert 77 so that the head portion 76 carries the hard insert (or tip) 77. In the specific embodiment, the hard insert 77 is made of a plurality of hard insert segments 78. Each one of the hard insert segments 78 has a generally chisel-shaped cutting edge 79. In this specific embodiment, the chisel-shaped cutting edge 79 has a thickness and is arcuate. The hard insert 77 may be made of hard materials such as, for example, tungsten carbide or cemented (cobalt) tungsten carbide or carbide pieces embedded in a cast steel matrix. One preferred composition for the tungsten carbide hard insert is between about 6 weight percent to about 12 weight percent cobalt with the balance tungsten carbide, except for impurities and possibly minor additives. The cast hard insert can be made along the lines of U.S. Pat. No. 4,608,318 to Makrides (assigned to Kennametal Inc. of Latrobe, Pa.).

There is a shank portion 82 adjacent to the axial rearward end 74. Shank portion 82 includes a reduced diameter section 84 that is defined so as to be between a frusto-conical shoulder 86 and a rearward shoulder 88. Axial rearward of the rearward shoulder 88 is a notch 92 that contains a groove 94.

The reduced diameter section 84 of the shank portion 82 carries a resilient retainer sleeve 98. The resilient retainer sleeve 98 has an axial forward end 100 and an axial rearward end 102. The resilient retainer sleeve may have a structure and properties along the line of the disclosure set forth in U.S. Pat. No. 4,201,421 to Den Besten et al.

To assembly the cutter bit 70 to any block segment (and with specific reference to block segment 48), the axial rearward end of the cutter bit 70 is inserted into the axial forward end 52 of the bore 50 until the frusto-conical shoulder contacts the portion of the block segment 48 that surrounds the axial forward end 52 of the bore 50. As is known in the art, the resilient retainer sleeve 98 expands against the bore wall 56 so as to frictionally engage the bore wall 56. This frictional engagement retains the cutter bit 70 within the bore 50 of the block segment 48. Once the cutter bit 70 is positioned within the bore 50 of the block segment 48, a pin (not illustrated) is used to engage the groove 94 so as to render the cutter bit 70 non-rotatable as is well-known in the pertinent art.

In operation, the road planing drum is rotated under the power of the engine so as to drive the hard carbide tip of the road planing bit into the asphaltic material so as break up and disintegrate the asphaltic material into smaller pieces or chunks that one can term debris. The debris is fed into a conveyor located behind the drum and carried away from the location of the road planing activity.

The pieces or chunks (i.e., debris) located near the opposite ends of the drum may sometimes be trapped between the opposite edge of the drum and the machine housing. In order to direct the debris past the opposite edges back into the helical flights of the drum, the drum contains the edge cutter assemblies. As described above, each edge cutter assembly has a portion thereof that extends past the opposite edge of the road planing drum so as to contact and thereby gather up the scattered debris. As can be appreciated, at least a portion of the hard insert of the chisel cutter bit presents a generally planar (or flat) surface. By using chisel cutter bits that have a generally planar surface geometry on at least a portion thereof, the edge cutter assembly has exhibited improved operational efficiency by an increase in the ability of the edge cutter assembly to gather and direct debris toward the helical flight.

As described above, during the road planing operation, it is not uncommon for the opposite ends of the drum, as well as the main tool holders (or blocks), to experience damage due to impingement against uncut roadway material wherein the uncut roadway material essentially defines the edge of the cutting path. By using edge cutters that function to cut the sides of the cutting path of the road planing drum, the ends of the drum and the main tool holders are protected from damage due to impingement against the uncut roadway material. Edge cutters also function to improve the quality of the cutting path by making a straighter edge in the roadway material that defines the cutting path.

The edge cutter assemblies have been useful to protect the opposite edges from damage. By using chisel cutter bits that have a generally planar surface geometry on at least a portion thereof, the edge cutter assemblies exhibit an improved ability to protect the opposite edges of the road planing drum.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. An edge cutter bit assembly for use in conjunction with a rotatable drum having an edge and a longitudinal surface, the edge cutter bit assembly comprising: a holder containing a plurality of bores wherein each bore carries a chisel cutter bit so that the chisel cutter bit is non-rotatable; and the holder being oriented with respect to the drum so that at least a portion of each one of the cutter bits extends past the edge of the drum and at least another portion of each one of the cutter bits does not extend past the edge of the drum.

2. The edge cutter bit assembly of claim 1 wherein the holder comprises a plurality of blocks, and each one of the blocks containing one of the bores.

3. The edge cutter assembly of claim 2 wherein the holder comprises a trio of the blocks, and the blocks being connected together.

4. The edge cutter bit assembly of claim 1 wherein the chisel cutter bit having an axial forward end and an axial rearward end, and the cutter bit having a head adjacent to the axial forward end wherein the head carries a hard tip.

5. The edge cutter bit assembly of claim 4 wherein the chisel cutter bit having a shank adjacent to the axial rearward end, and the shank carries a resilient retainer that frictionally engages the bore corresponding to the cutter bit.

6. The edge cutter bit assembly of claim 4 wherein the hard tip comprises one of the group comprising cemented carbide and hard particles embedded in a cast steel matrix.

7. The edge cutter bit assembly of claim 4 wherein the hard tip presents a generally chisel-shaped cutting edge having a thickness.

8. The edge cutter bit assembly of claim 4 wherein the hard tip comprises a plurality of hard segments.

9. The edge cutter bit assembly of claim 1 wherein the holder having a central longitudinal axis, and the holder being disposed so that the central longitudinal axis is at an angle with respect to a line normal to the longitudinal surface of the drum equal to between about zero degrees and about thirty degrees.

10. The edge cutter bit assembly of claim 1 wherein the holder having a central longitudinal axis, and the holder being disposed so that the central longitudinal axis is at an angle with respect to a line normal to the longitudinal surface of the drum equal to between about five degrees and about fifteen degrees.

11. A rotatable drum assembly comprising: a drum having at least one edge and a longitudinal surface; an edge cutter bit assembly mounted to the surface of the drum; the edge cutter assembly comprising: a holder containing a plurality of bores wherein each bore carries a chisel cutter bit so that the chisel cutter bit is non-rotatable; and the holder being oriented with respect to the drum so that at least a portion of each one of the cutter bits extends past the edge of the drum and at least another portion of each one of the cutter bits does not extend past the edge of the drum.

12. The rotatable drum assembly of claim 11 wherein the holder comprises a plurality of blocks, and each one of the blocks containing one of the bores.

13. The rotatable drum assembly of claim 12 wherein the holder comprises a trio of the blocks, and the blocks being connected together.

14. The rotatable drum assembly of claim 11 wherein the chisel cutter bit having an axial forward end and an axial rearward end, and the cutter bit having a head adjacent to the axial forward end wherein the head carries a hard tip.

15. The rotatable drum assembly of claim 14 wherein the chisel cutter bit having a shank adjacent to the axial rearward end, and the shank carries a resilient retainer that frictionally engages the bore corresponding to the cutter bit.

16. The rotatable drum assembly of claim 14 wherein the hard tip comprises one of the group comprising cemented carbide and hard particles embedded in a cast steel matrix.

17. The rotatable drum assembly of claim 14 wherein the hard tip presents a generally chisel-shaped cutting edge having a thickness.

18. The rotatable drum assembly of claim 14 wherein the hard tip comprises a plurality of hard segments.

19. A rotatable drum assembly comprising: a drum having at least one edge and a longitudinal surface; an edge cutter bit assembly mounted to the surface of the drum; the edge cutter assembly comprising: a holder containing a plurality of bores wherein each bore carries a chisel cutter bit so that the chisel cutter bit is non-rotatable; and the holder being oriented with respect to the drum so that at least a portion of each one of the cutter bits extends past the edge of the drum, wherein the holder having a central longitudinal axis, and the holder being disposed so that the central longitudinal axis is at an angle with respect to a line normal to the longitudinal surface of the drum equal to between about zero degrees and about thirty degrees.

20. The rotatable drum assembly of claim 19 wherein the holder having a central longitudinal axis, and the holder being disposed so that the central longitudinal axis is at an angle with respect to a line normal to the longitudinal surface of the drum equal to between about five degrees and about fifteen degrees.

* * * * *